US005354222A

United States Patent [19]

Elias

[11] Patent Number: 5,354,222

[45] Date of Patent: Oct. 11, 1994

[54] WATER RESCUE SLED

[76] Inventor: Daniel S. Elias, 212 Lolita St., Encinitas, Calif. 92024

[21] Appl. No.: 144,888

[22] Filed: Oct. 26, 1993

[51] Int. Cl.[5] ..... B63B 21/56

[52] U.S. Cl. ..... 441/80; 114/249

[58] Field of Search ..... 441/65, 35, 40, 129, 441/130, 131, 125, 136, 80; 114/267, 242, 253, 249

[56] References Cited

U.S. PATENT DOCUMENTS

| | | | |
|---|---|---|---|
| 3,461,829 | 8/1969 | Mosvold | 114/249 |
| 3,561,025 | 2/1971 | Teach | 441/65 |
| 4,756,700 | 7/1988 | Coleman | 114/242 |
| 5,119,752 | 6/1992 | Doherty | 114/270 |

FOREIGN PATENT DOCUMENTS

| | | | |
|---|---|---|---|
| 96193 | 5/1987 | Japan | 441/80 |
| 8505340 | 12/1985 | World Int. Prop. O. | 441/80 |

*Primary Examiner*—Stephen P. Avila

*Attorney, Agent, or Firm*—Stetina and Brunda

[57] ABSTRACT

A water rescue sled for towing an incapacitated victim behind a personal watercraft has a buoyant body configured to support a recumbent victim thereupon. A coupling attaches the buoyant body to the personal watercraft in a manner providing at least two degrees of freedom so as to minimize stresses to both the personal watercraft and the water rescue sled during use thereof. The water rescue sled preferably further comprises a plurality of ties for facilitating securing of a victim disposed upon the buoyant body thereto. Ropes, straps, webbing, etc. may be attached to the ties and placed over the victim so as to maintain the victim safely upon the upper surface of the buoyant body. The ties are preferably configured as handles so as to facilitate carrying of the water rescue sled and victim. Thus, the water rescue sled of the present invention may optionally function as a backboard for maintaining the spine in a straight and immobile configuration during transport.

10 Claims, 1 Drawing Sheet

WATER RESCUE SLED

FIELD OF THE INVENTION

The present invention relates generally to water rescue devices and more particularly to a water rescue sled for towing an incapacitated victim behind a personal water craft.

BACKGROUND OF THE INVENTION

Personal watercraft, such as the JETSKI manufactured by Kawasaki, have attained widespread use by lifeguards and rescue personnel for water rescue operations. It is common for a lifeguard to utilize such a personal watercraft to quickly respond to an emergency situation. The speed afforded by such personal watercraft often makes the difference between life and death for an accident victim. Thus, the use of such personal watercraft for water rescue operations has resulted in saving numerous lives.

However, although such personal watercraft have proven generally suitable for water rescue purposes, they possess inherent deficiencies which detract from their overall effectiveness in the marketplace. One major deficiency is the inability to easily and safely transport the victim from the pickup point to the shore. Typically the victim must be maneuvered into either a sitting or straddling position upon the personal watercraft. Such positioning of the victim is inherently time consuming and potentially detrimental to the victim's well-being, particularly in incidences of spinal injury.

As such, it would be beneficial to provide a quick and safe means for transporting accident victims from the pickup site to the shore utilizing personal watercraft.

SUMMARY OF THE INVENTION

The present invention specifically addresses and alleviates the above-mentioned deficiencies associated with the prior art. More particularly, the present invention comprises a water rescue sled for towing an incapacitated victim behind a personal watercraft. The water rescue sled comprises a buoyant body configured to support a recumbent victim thereupon. A coupling attaches the buoyant body to the personal watercraft in a manner providing at least two degrees of freedom so as to minimize mechanical stress to both the personal watercraft and the water rescue sled during use thereof. An incapacitated victim disposed upon the buoyant body is thus towable from an accident site to shore by a personal watercraft to which the water rescue sled is attached.

The water rescue sled preferably further comprises a plurality of ties for facilitating securing of a victim disposed upon the buoyant body thereto. Ropes, straps, webbing, nets, etc. may be attached to the ties and placed over the victim so as to maintain the victim safely upon the upper surface of the buoyant body.

The ties are preferably configured as handles so as to facilitate carrying of the water rescue sled and victim. Thus, the water rescue sled of the present invention may optionally function as a backboard for maintaining the spine in a straight and immobile configuration during transport.

The deck or upper surface of the water rescue sled is preferably configured to facilitate storage of various emergency and rescue equipment, such as neck braces, straps, a diving mask, spare air (compressed oxygen), etc. Those skilled in the art will recognize that various other equipment may similarly be desirable and that various configurations of compartment or other storage means are suitable.

The buoyant body preferably comprises a buoyant foam core, a resinous skin substantially covering the foam core, and a reinforced resinous bow formed forward of the foam core. The coupling is attached to the reinforced resinous bow in a manner which minimizes stress so as to insure maintenance of the structural integrity of the water rescue sled of the present invention.

The resinous skin and resinous bow are preferably comprised of fiberglass. However, those skilled in the art will recognize that various other resinous materials, i.e., KEVLAR, etc., are likewise suitable. The foam core is preferably comprised of polyurethane. Similarly, those skilled in the art will recognize that various other materials, i.e., various plastic foams, wood, etc., are likewise suitable.

The coupling preferably comprises a universal joint wherein a first coupling member is pivotally attached to the buoyant body so as to more horizontally with respect to the buoyant body and a second coupling member is rigidly attachable to the personal watercraft and pivotally attached to the first coupling member so as to move vertically with respect thereto.

In the preferred embodiment of the present invention at least one, preferably two, tethers interconnect the buoyant body and the personal watercraft. One tether is located upon either side of the coupling so as to limit horizontal motion of the coupling. The tethers also provide redundant attachment of the personal watercraft and the water rescue sled so as to maintain interconnection thereof in the event of a coupling failure.

The buoyant body preferably comprises a concave upper surface for receiving and holding the incapacitated victim. The concave upper surface tends to maintain positioning of the incapacitated victim thereupon, particularly when the incapacitated victim is initially placed upon the buoyant body, prior to being secured in position with straps, ropes, webbing, etc.

The buoyant body preferably further comprises a concave, foiled, or V-bottomed undersurface so as to facilitate hydroplaning and/or improved maneuvering.

The upper-surface or deck of the water rescue sled preferably comprises a polymer material, such as polyethylene, which defines a resilient pad upon the upper surface of the water rescue sled so as to increase the comfort and safety of the rider or victim.

The coupling preferably further comprises a resilient covering formed upon the first coupling member so as to cushion contact of the first coupling member with said buoyant body. The resilient covering preferably comprises a foam polymer material. Those skilled in the art will recognize that various such materials are suitable.

The buoyant body preferably comprises a durable sleeve, preferably formed of a water-compatible metal, such as stainless steel, positioned through the reinforced resinous bow. Those skilled in the art will recognize that various other materials, i.e., wood, plastic, fiberglass, etc., are likewise suitable for use as a durable sleeve. The first coupling member is attached to the buoyant body via a pin passing through the first coupling member and the sleeve so as to facilitate horizontal pivoting of the first coupling member relative to the water rescue sled.

The second coupling member is attached to the first coupling member via pivot pins passing through both coupling members.

These, as well as other, advantages of the present invention will be more apparent from the following description and drawings. It is understood that changes in the specific structure shown and described may be made within the scope of the claims without departing from the spirit of the invention.

DETAILED DESCRIPTION OF THE PREFERRED EMBODIMENT

The detailed description set forth below in connection with the appended drawings is intended as a description of the presently preferred embodiment of the invention, and is not intended to represent the only form in which the present invention may be constructed or utilized. The description sets forth the functions and sequence of steps for constructing and operating the invention in connection with the illustrated embodiment. It is to be understood, however, that the same or equivalent functions and sequences may be accomplished by different embodiments that are also intended to be encompassed within the spirit and scope of the invention.

Figure 1:
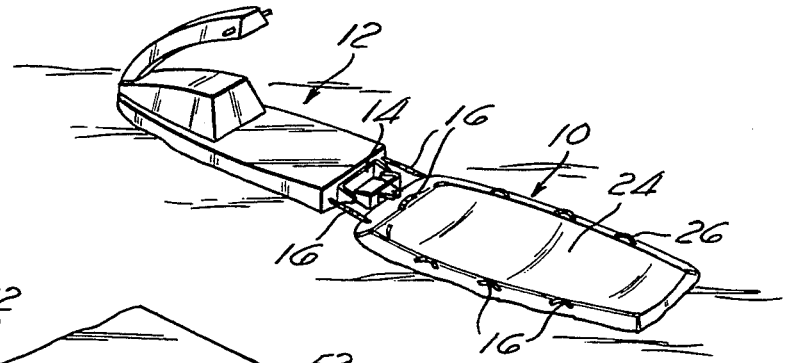
FIG. 1 is a perspective view of the water rescue sled of the present invention attached to a personal watercraft.
Figure 2:
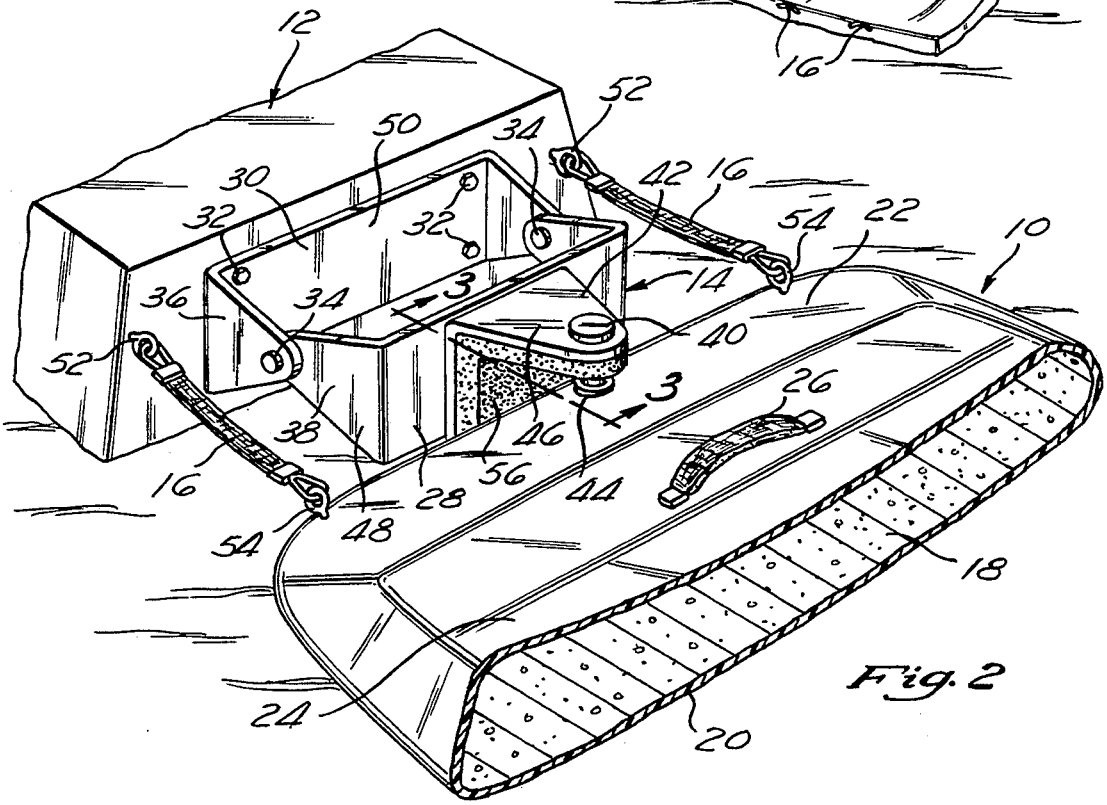
FIG. 2 is an enlarged perspective view of the coupling and the tethers interconnecting the water rescue sled and the personal watercraft of FIG. 1.
Figure 3:
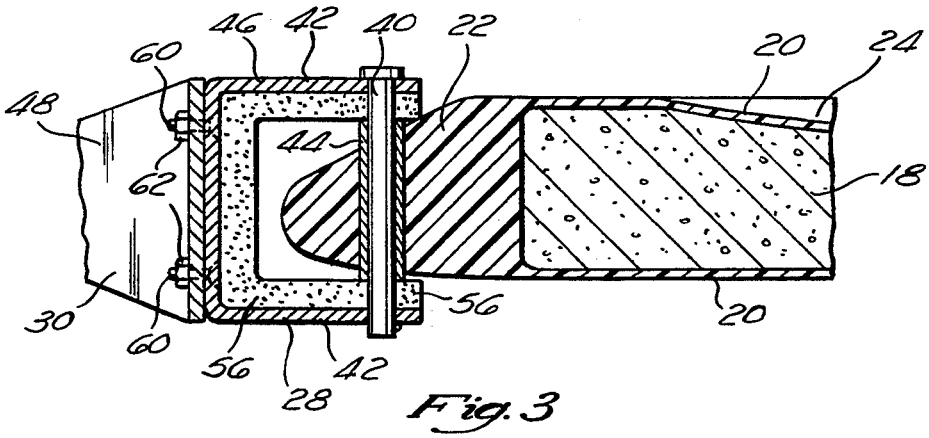
FIG. 3 is an enlarged cross-sectional view taken along lines 3 of FIG. 2 and showing the sleeve disposed through the reinforced resinous bow of the water rescue sled.

The water rescue sled of the present invention is illustrated in FIGS. 1–3 which depict a presently preferred embodiment of the invention.

Referring now to FIGS. 1–3, the water rescue sled of the present invention is generally comprised of a buoyant body 10 attached to a personal watercraft 12 via a coupling 14 and two tethers 16. The buoyant body 10 preferably comprises a foam core 18 substantially covered by a resinous skin 20 and also having a reinforced resinous bow 22. The reinforced resinous bow 22 is comprised entirely of the resinous material which forms the skin 20 of the buoyant body, and thus lacks any foam. Thus, the strength of the resinous bow 22 is substantially greater than that of the much thinner skin 20.

The resinous skin 20 and the reinforced resinous bow 22 are preferably comprised of fiberglass. Those skilled in the art will recognize that various other resinous webbing-type material, i.e., KEVLAR, etc., are likewise suitable.

The use of a universal joint-type of coupling for interconnecting the buoyant body 10 and the personal watercraft 12 is preferred. Such a universal type of coupling minimizes stresses applied to the buoyant body 10 and the personal watercraft 12 caused by waves and swells as the personal watercraft 12 and the buoyant body 10 travel to and from the rescue site.

The upper surface 24 of the buoyant body 10 is preferably concave so as to accommodate an incapacitated victim in a manner which tends to maintain positioning of the incapacitated victim thereupon.

A plurality of ties 26 are formed about the periphery of the upper surface 24 of the buoyant body 10. The ties 26 facilitate attachment of ropes, straps, webbing, nets, etc., thereto in a manner which facilitates securing of the incapacitated victim upon the buoyant body 10.

The ties 26 are preferably configured as handles such that they may be utilized to carry the buoyant body 10 and the incapacitated victim. Thus, the buoyant body 10 may function as a backboard so as to maintain straight and stable positioning of the spine during transport. This is particularly useful for those victims for which a spinal injury is suspected.

The coupling 14 is comprised of a first coupling member 28 pivotally attached to the buoyant body 10 so as to move horizontally with respect to the buoyant body 10 and a second coupling member 30 rigidly attached to the personal watercraft 12 and pivotally attached to the first coupling member 28 so as to move vertically with respect to the first coupling member 28.

The second coupling member 30 is rigidly attached to the personal watercraft 12 via bolts 32. The second coupling member 30 is pivotally attached to the first coupling member 28 via pivot pins 34 which pass through arms 36 of the second coupling member 30 and corresponding arms 38 of the first coupling member 28.

The first coupling member 28 is pivotally attached to the reinforced resinous bow 22 of the buoyant body 10 via pivot pin 40 extending through arms 42 of the first coupling member 28 and stainless steel sleeve 44 disposed within the reinforced resinous bow 22 of the buoyant body 10.

The durable sleeve 44 may alternatively be comprised of fiberglass. Those skilled in the art will recognize that various other materials, i.e., wood, plastic, and various water-compatible metals, are likewise suitable.

The coupling 14 comprises a generally U-shaped sheet steel first bracket 46 rigidly attached to a generally U-shaped sheet metal second bracket 48 (the first 46 and second 48 brackets defining the first coupling member 28), which in turn is pivotally attached to a generally U-shaped sheet metal third bracket 50 (the third bracket 50 defining the second coupling member 30) rigidly attached to the personal watercraft 12. The first bracket 46 is attached to the second bracket 48 via bolts 60 and nuts 62.

The tethers 16 are attached to the personal watercraft 12 via eye screws 52 threaded thereinto and are attached to the water rescue sled similarly via eye screws 54 threaded thereinto. Those skilled in the art will recognize that various other means for attaching the tethers 16 to the personal watercraft 12 and the water rescue sled 10 are likewise suitable.

A resilient material 56 covers the inner surface of the first bracket 46 in a manner which cushions contact of the first bracket 46 with the water rescue sled 10.

It is understood that the exemplary water rescue sled described herein and shown in the drawings represents only a presently preferred embodiment of the invention. Indeed, various modifications and additions may be made to such embodiment without departing from the spirit and scope of the invention. For example, the buoyant body 10 may be constructed by various means. The buoyant body may be of generally hollow plastic, formed of wood, or various other buoyant materials. Also, those skilled in the art will recognize that various other configurations of universal joints are likewise suitable for coupling the buoyant body to the personal watercraft. Additionally, the water rescue sled of the present invention may be configured to be utilized for recreational purposes as well as rescue purposes. Thus, these and other modifications and additions may be obvious to those skilled in the art and may be implemented to adapt the present invention for use in a variety of different applications.

What is claimed is:

1. A water rescue sled for towing an incapacitated person behind a personal water craft, the water rescue sled comprising:

a buoyant body configured to support a recumbent person thereupon;

a coupling for attaching said buoyant body to the personal water craft;

wherein an incapacitated person disposed upon said buoyant body is towable by the personal water craft to which said buoyant body is attached;

wherein said coupling comprises a first coupling member pivotally attached to said buoyant body so as to move horizontally with respect to said buoyant body and a second coupling member rigidly attachable to the personal water craft and pivotally attachable to said first coupling member so as to move vertically with respect to said first coupling member;

wherein said buoyant body is formed having a buoyant foam core and a resinous skin substantially covering said foam core; and a resinous bow formed forward of said core and further comprising a durable sleeve formed through said resinous bow, said first coupling member being attached to said buoyant body via a pin passing through said first coupling member and said sleeve.

2. The water rescue sled as recited in claim 1 wherein said resinous skin and said resinous bow comprise fiberglass.

3. The water rescue sled as recited in claim 1 wherein said sleeve is comprised of metal.

4. The water rescue sled as recited in claim 1 wherein said sleeve is comprised of stainless steel.

5. The water rescue sled as recited in claim 1 wherein said sleeve is comprised of fiberglass.

6. The water rescue sled as recited in claim 1 further comprising at least one tether interconnecting said buoyant body and the personal watercraft.

7. The water rescue sled as recited in claim 1 wherein the buoyant body comprises a concave upper surface for receiving and holding the incapacitated person.

8. The water rescue sled as recited in claim 1 further comprising a plurality of ties for facilitating securing of the incapacitated person disposed upon said buoyant body thereto.

9. The water rescue sled as recited in claim 8 wherein said ties comprise handles with which said water rescue sled is carryable.

10. A water rescue sled for towing an incapacitated person behind a personal watercraft, the water rescue sled comprising:

a ) a buoyant body configured to support a recumbent person thereupon, said buoyant body comprising:

i) a buoyant foam core;

ii) a fiberglass skin substantially covering said foam core;

iii) a reinforced fiberglass bow formed forward of said foam core;

iv) a stainless steel sleeve formed through said bow; and v) a concave upper surface;

b) a plurality of handles formed upon said buoyant body with which said water rescue sled is carryable .and which facilitate securing of a person disposed upon said buoyant body thereto;

c) a universal joint coupling for attaching said buoyant body to the personal watercraft, said coupling comprising:

i) a first coupling member pivotally attached to said buoyant body so as to move horizontally with respect to said buoyant body;

ii) a second coupling member rigidly attachable to the personal watercraft and pivotally attached to said first coupling member so as to move vertically with respect thereto; and iii) a resilient covering formed upon said first coupling member so as to cushion contact of said first coupling member with said buoyant body;

d) a pin passing through said first coupling member and said sleeve to attach said coupling to said buoyant body;

e) two tethers interconnecting said personal watercraft and said buoyant body, one tether disposed upon either side of said coupling; and f) wherein an incapacitated person disposed upon the concave surface of said buoyant body is towable by the personal watercraft to which the buoyant body is attached.

* * * * *